US007637330B2

(12) United States Patent
Angman et al.

(10) Patent No.: US 7,637,330 B2
(45) Date of Patent: Dec. 29, 2009

(54) CASING BOTTOM HOLE ASSEMBLY RETRIEVAL PROCESS

(75) Inventors: Per G. Angman, Calgary (CA); Robert M. Tessari, Calgary (CA); Tommy M. Warren, Coweta, OK (US)

(73) Assignee: Tesco Corporation, Calgary (CA)

( * ) Notice: Subject to any disclaimer, the term of this patent is extended or adjusted under 35 U.S.C. 154(b) by 250 days.

(21) Appl. No.: 11/461,918

(22) Filed: Aug. 2, 2006

(65) Prior Publication Data

US 2007/0068677 A1 Mar. 29, 2007

Related U.S. Application Data

(60) Provisional application No. 60/595,745, filed on Aug. 2, 2005, provisional application No. 60/820,407, filed on Jul. 26, 2006.

(51) Int. Cl.
*E21B 7/20* (2006.01)

(52) U.S. Cl. ..... 175/257; 175/23; 166/377

(58) Field of Classification Search ..... 166/377; 175/23, 257

See application file for complete search history.

(56) References Cited

U.S. PATENT DOCUMENTS

| | | | | |
|---|---|---|---|---|
| 2,277,989 | A | 3/1942 | Kinnear | |
| 2,876,994 | A | 3/1959 | Gadeberg | |
| 2,890,756 | A | 6/1959 | Middleton | |
| 2,997,119 | A | 8/1961 | Goodwin | |
| 3,543,870 | A | 12/1970 | Martinsen et at | |
| 3,572,431 | A | 3/1971 | Hammon | |
| 3,701,387 | A | 10/1972 | Koot | |
| 3,874,466 | A | 4/1975 | Fulford | |
| 4,133,396 | A | 1/1979 | Tschirky | |
| 4,384,616 | A | 5/1983 | Dellinger | |
| 4,921,577 | A | 5/1990 | Eubank | |
| 4,984,634 | A * | 1/1991 | Pilla | 166/250.17 |
| 5,181,571 | A | 1/1993 | Mueller et al. | |

(Continued)

FOREIGN PATENT DOCUMENTS

| | | |
|---|---|---|
| WO | WO2007/140612 | 12/2007 |

OTHER PUBLICATIONS

Advanced Drilling Solutions, Lessons from the FSU, vol. II, authors Yakov A. Gelfgat, Mikhail Y. Gelfgat and Yuri S. Lopatin, cover page, copyright page dated 2003, and pp. 263, 390-393.

*Primary Examiner*—David J Bagnell
*Assistant Examiner*—Brad Harcourt
(74) *Attorney, Agent, or Firm*—Bracewell & Giuliani LLP

(57) ABSTRACT

A process for retrieving a bottom hole assembly through a casing string may include: installing a casing string in a borehole, the casing string including a bottom hole assembly releasably engaged thereto and moveable through an inner diameter of the casing string; releasing the bottom hole assembly from engagement with the casing string; reducing hydrostatic pressure in the casing string inner diameter above the bottom hole assembly so that the casing string inner diameter pressure above the bottom hole assembly is lower than a fluid pressure below the bottom hole assembly; permitting reverse circulation down through an annulus between the casing string and the borehole to permit the bottom hole assembly to rise up through the casing string toward the surface; and retrieving the bottom hole assembly from the casing string.

21 Claims, 5 Drawing Sheets

U.S. PATENT DOCUMENTS 5,186,265 A 2/1993 Hensen et al.
5,402,850 A 4/1995 Lalande et al.
2004/0256109 A1 12/2004 Johnson
2007/0051538 A1* 3/2007 Angman et al. ..... 175/57

* cited by examiner

CASING BOTTOM HOLE ASSEMBLY RETRIEVAL PROCESS

FIELD OF THE INVENTION

The invention relates to a process for retrieving a bottom hole assembly from a casing string.

BACKGROUND

In operations relating to drilling boreholes with casing or running casing into a previously drilled borehole, a casing string may be used with a bottom hole assembly connected at its bottom end. During these operations it may be desired to retrieve the bottom hole assembly from the casing string for replacement, repair or final removal. The bottom hole assembly may be sized to be retrievable through the casing string inner diameter.

In a traditional retrieval procedure, a release tool is conveyed downhole to manipulate and unlock a lock assembly on the bottom hole assembly. The release tool and the bottom hole assembly are then tripped either independently or, preferably, together to surface. Generally, a wireline is used to engage and pull the lock and bottom hole assemblies to surface.

A provision must be made for the wireline to be run through the casing to retrieve the BHA. It is often advantageous to circulate drilling fluid down the ID of the casing while the wireline is being run and the BHA recovered to ensure that any influx of formation fluids is circulated out of the well in a controlled manner. It is also advantageous to reciprocate the casing while the BHA is being recovered so that the casing does not become stuck in the borehole. The top drive and casing drive system must be attached to the casing in order for circulation and reciprocation of the casing to be accomplished.

The drilling rig used to drill with casing may be a specially designed rig that facilitates the efficient operation of the wireline for running and retrieving the drilling BHA. The rig also must be equipped with a wireline unit that is capable of handling the drilling BHAs. For rigs designed for casing drilling, this wireline unit may be provided as an integral part of the rig.

Access for the wireline is provided through the top of the swivel, which may be incorporated as an integral part of the top drive. Utilizing a split crown block and split traveling block may facilitate the wireline access through the top of the swivel. Split blocks are ones where the sheaves used for carrying the drilling line are divided into two groups spaced laterally apart. The split crown arrangement allows a wireline sheave to be hung at the crown of the rig so the wireline can be aligned with the central axis of the drillstring. The split traveling block provides room for a wireline stripper assembly and wireline BOP to be attached to the top of the swivel to prevent the pressurized drilling fluid from escaping around the wireline as it is being run into and pulled from the casing. In some situations, it may be sufficient to provide only a split traveling block as the fleet angle from having the crown sheave offset slightly from the central axis of the drillstring.

The drilling BHA may be quite heavy and weigh as much as 30,000 pounds. A large braided cable, for example ¾" in diameter, may be required to support this much weight and the sheaves used with such a cable are relatively large in diameter, for example 30" in diameter. It is important that the sheaves and wireline pressure control equipment be positioned so that the wireline can enter the casing along its central axis. Otherwise, the cable will exert lateral forces on the casing or other equipment and will quickly cut into the casing inner wall.

As will be appreciated, wireline retrieval processes are costly, time consuming and complex.

SUMMARY OF THE INVENTION

In accordance with one aspect of the present invention, there is provided a process for retrieving a bottom hole assembly through a casing string, the method comprising: installing a casing string in a borehole, the casing string including a bottom hole assembly releasably engaged thereto and moveable through an inner diameter of the casing string; releasing the bottom hole assembly from engagement with the casing string; reducing hydrostatic pressure in the casing string inner diameter above the bottom hole assembly so that the casing string inner diameter pressure above the bottom hole assembly is lower than a fluid pressure below the bottom hole assembly; permitting reverse circulation down through an annulus between the casing string and the borehole to permit the bottom hole assembly to rise up through the casing string toward the surface; and retrieving the bottom hole assembly from the casing string.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1A:
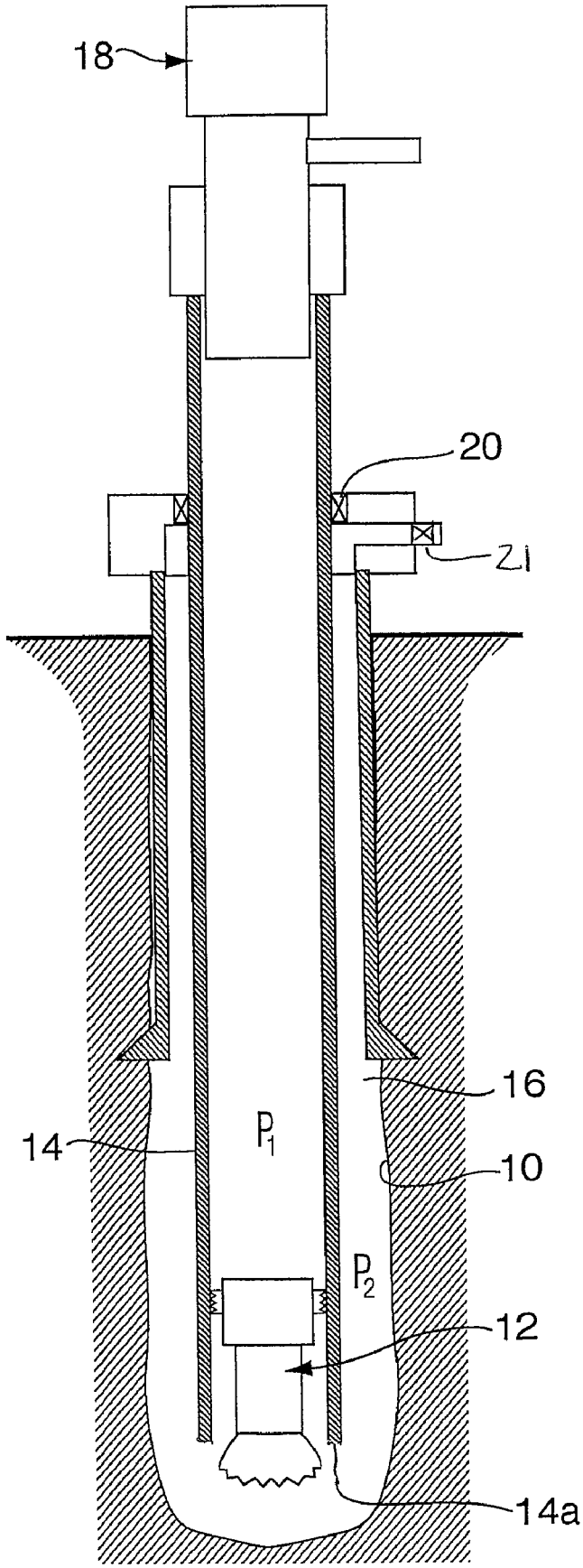
FIGS. 1*a*, 1*b* and 1*c* are schematic views through a well bore undergoing a bottom hole assembly retrieval process according to one aspect of the present invention.
Figure 1B:
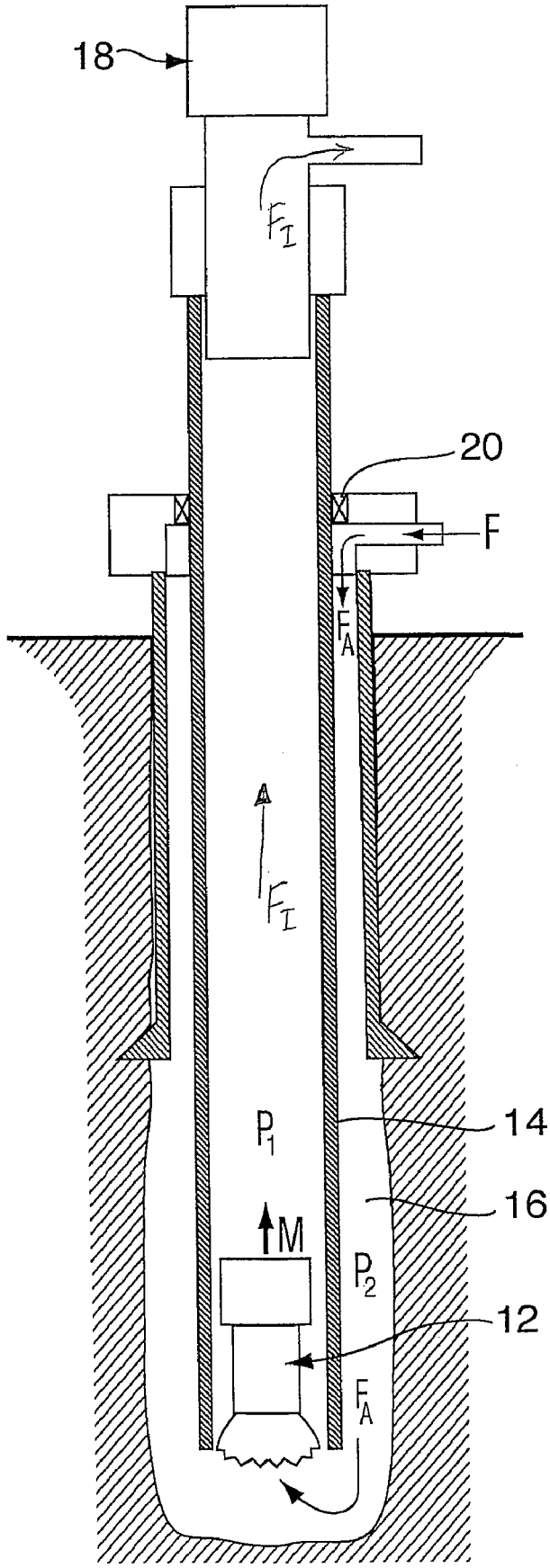
Figure 1C:
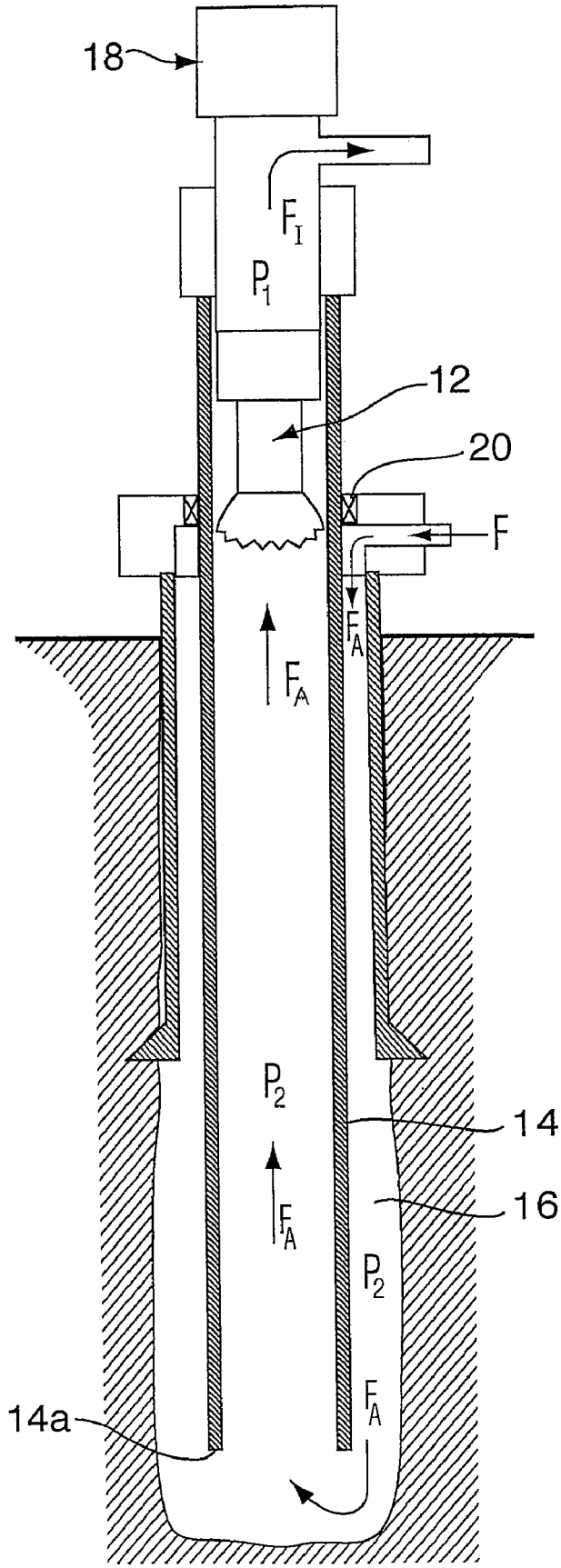

FIGS. 1*a*, 1*b*, and 1*c* show schematic sectional views through a well bore 10 wherein a bottom hole assembly 12 is being retrieved from a distal end 14*a* of a casing string 14. Such a retrieval process may sometimes be referred to as "tripping".

The casing string is located in well bore 10 and an annulus 16 is formed between casing string 14 and the well bore. As will be appreciated, the casing string 14 inner diameter and annulus 16 are generally filled with well bore and/or drilling fluids, such as drilling mud. The pressure of the fluids in the well bore may be controlled by devices such as those on the casing handling tools 18 and those on the well bore such as a blow out preventer 20 and well head valving 21.

Bottom hole assembly 12 is, prior to retrieval, releasably engaged to the casing string. Although releasably engaged to the casing string, bottom hole assembly 12 is selected to be sizable to pass though the casing inner diameter. Bottom hole assembly 12 may be selected to restrict or seal against fluid flow therethrough or therepast from annulus 16 to the inner diameter of casing string 14 such that a hydrostatic pressure P1 in the casing string above bottom hole assembly 12 may be maintained substantially separately from a hydrostatic pressure P2 below the bottom hole assembly, the most part of which in FIG. 1*a* is in the annulus.

When it is desired to retrieve the bottom hole assembly from the casing string, the bottom hole assembly may be released from engagement with the casing string. Thereafter, as shown in FIG. 1*b*, the hydrostatic pressure P1 in the casing string inner diameter may be reduced in various ways so that the casing string inner diameter pressure P1 is lower than the pressure P2. Of course, the hydrostatic pressure in a well is determined by depth so, to clarify the referenced relative pressures P1 and P2 should be compared at corresponding elevations in the well, for example, directly above and directly below the bottom hole assembly. Pressure reduction in FIG. 1 is illustrated by the lifting of fluid from the casing string, arrows $F_I$. By permitting reverse circulation, arrows $F_A$, of well bore fluid down through the annulus, the pressure differential of P1<P2 about bottom hole assembly 12 drives, arrow M, the bottom hole assembly to rise up through the casing string toward the surface. Once the bottom hole assembly arrives at or approaches surface (FIG. 1*c*), it may be retrieved from the casing string.

In such a process a wireline need not be used to unlock and/or trip the bottom hole assembly. For example, no split block or wireline entry sub is required and few, if any, rig modifications need be implemented. Using a process according to the present invention, any or all of circulation through the well bore and/or reciprocation and rotation of the casing string may be maintained during the retrieval process. Also, the well bore may be controlled during tripping, since pressure controls can be in place. Control of the pressure differential may permit the trip speed to be controlled.

In the process, the casing string may be located in the borehole for any of various reasons including, for example, as a result of using the casing string as a drill string or running in the casing string after the borehole has been drilled. As such, it is to be appreciated that the bottom hole assembly may take various forms including for example, one or more of a primary drill bit, an under reamer, a reaming tool, borehole measurement tool, a directional drilling tool, a mud motor, etc.

The bottom hole assembly may be secured to the casing string in any of various ways such as for example by packers, lock dogs, grippers, interlocking parts, etc. The bottom hole assembly may be released from engagement with the casing string, again in various ways, such as by signaling to a release mechanism through fluid pressure manipulation, acoustics, electrical connections, etc. or by manipulation by a drop tool, by a fluid conveyed dart, by adjusting fluid pressure in the casing, etc.

Various processes may be used to reduce the pressure P1 in the casing string. For example, fluid in the casing string above the bottom hole assembly may be pumped out or lifted out as by injection of a lighter lifting fluid or by a venturi effect to create suction in the casing string inner diameter. Alternately, the fluid above the bottom hole assembly may be replaced by a fluid of reduced density for example, as by replacement of drilling mud with water.

The wellbore system may be adjusted to permit reverse circulation. In one embodiment, this may include opening valving 21 so that fluid may be drawn into the annulus as the bottom hole assembly is lifted out of the casing. This process will ensure that the pressure differential P1<P2 is maintained. In another embodiment, fluid may be pumped into annulus 16. In yet another embodiment, external pressure P2 can be raised to enhance tripping, but such pressure need not, if desired, be raised to levels that would damage the formation.

The bottom hole assembly can be caught and conveyed to surface in any of various ways, as by suction, latching or magnetic engagement by a tool introduced or already present in the well bore, by catching in a receptacle, etc.

Of course, the steps in the above-noted method may be modified in various ways including, for example, in their order. For example, it may be possible to release the bottom hole assembly from engagement with the casing string before, during and/or after reducing the hydrostatic pressure P1. In another example, the step of reducing the hydrostatic pressure may occur before or at the same time as permitting reverse circulation.

Figure 2:
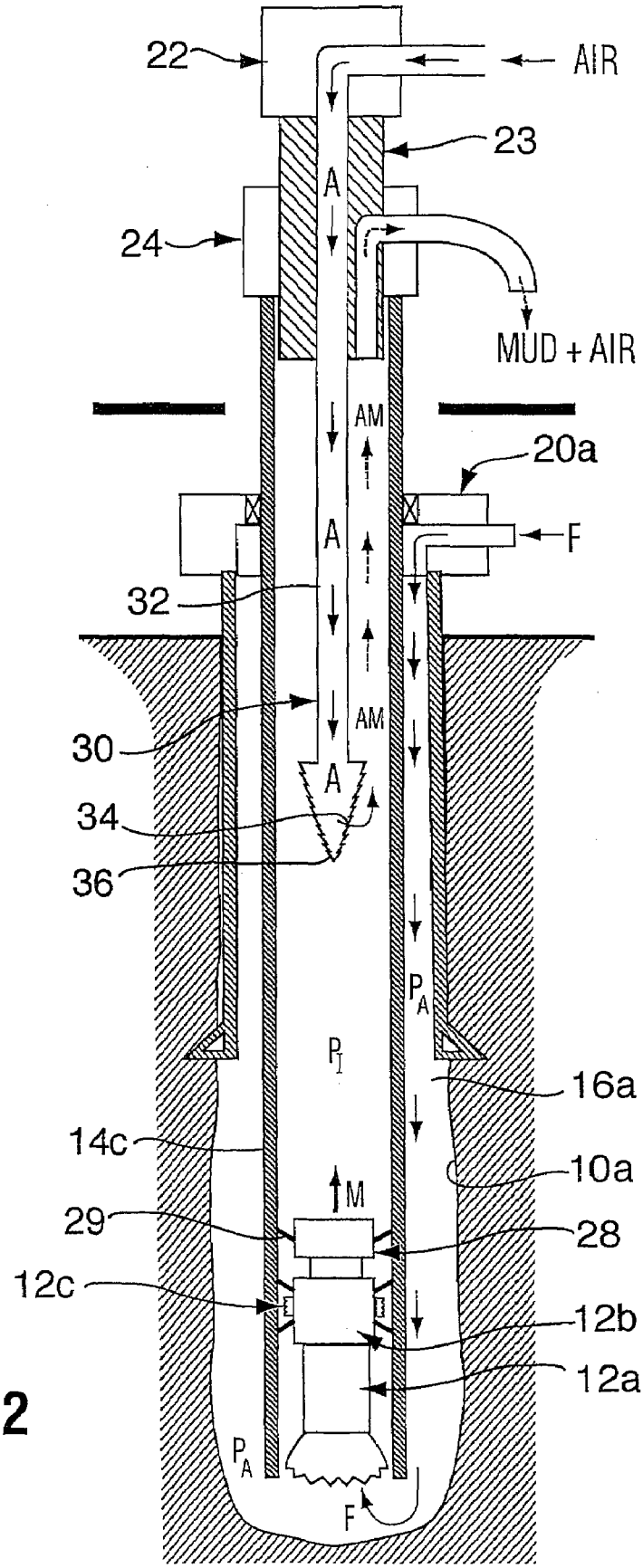
FIG. 2 is another schematic view through a well bore in which a bottom hole assembly is being retrieved according to one aspect of the present invention.

With reference to FIG. 2, another process is shown to retrieve a bottom hole assembly 12*a* through a casing string 14*c*. In this illustrated embodiment, a borehole 10*a* has been drilled by casing string 14*c* including bottom hole assembly 12*a* locked thereto by a drilling lock assembly 12*b*. Drilling assembly 12*b* is shown with its locking mechanism 12*c* retracted from engagement with the casing string. Casing string 14*c* may be handled and driven from surface by a top drive 22 and casing drive tool 23. Well bore pressures and fluid circulation may be controlled by a blow out preventer 20*a*, a return swivel 24, etc.

When it is desired to retrieve the bottom hole assembly, either to repair it, replace it or when total depth is reached, a release tool 28 is conveyed, as by pumping, dropping, etc., downhole. In the illustrated embodiment, release tool 28 includes a seal cup 29 that permits the tool to be pumped down into engagement with drill lock assembly 12*b* of the bottom hole assembly. The release tool manipulates drill lock assembly 12*b*, as for example by engagement with it, to unlock the bottom hole assembly from engagement with casing string 14*c* so that the bottom hole assembly, the drill lock assembly and the release tool are free to move through the casing string (as shown by arrow M).

To create a pressure differential across the bottom hole assembly in this illustrated embodiment, fluid may be drawn or lifted from the casing string inner diameter to reduce the hydrostatic head $P_I$ above bottom hole assembly 12*a* to create lift. Fluid may be drawn or lifted by a device such as a pump or, as shown, an injection lift device 30 to inject a suction fluid flow, such as shown by arrows A, that moves toward surface causing liquid in the casing string inner diameter to be drawn with it toward surface, as shown by arrows AM. Injection lift device 30 can be provided by running into the casing string with a tubular string 32 including at least one lower port 34. Tubular string 32 may be of a diameter smaller than the casing string such as of drill pipe, coiled tubing, etc. $P_I$ may be reduced by injecting a fluid through port 34, the fluid being selected to move towards surface as by use of an injection force directed towards surface and/or by selecting the density of the injected fluid to be less than the density of the fluid already in the casing string inner diameter. A fluid such as gas (air, natural gas, nitrogen, etc.) or liquid (mud, water, etc.), preferably of a density less than the liquid in the casing string inner diameter may be used to generate lift. The injected fluid may alternately generate lift by generation of a venturi effect to draw liquid out of the casing string.

The reduction of pressure $P_I$ inside the casing string relative to the higher pressure $P_A$ in the annulus about the casing string causes the bottom hole assembly to be tripped out of the hole. The annulus may be filled (arrow F) to adjust pressure $P_A$ to maintain a pressure differential $P_I<P_A$. Control of the pressure differential may provide control of the speed of tripping.

Tubular string 32 may be provided with a latch device 36, such as fishing spear, to engage the assembly and/or release tool 28 (as will be the case in the illustrated embodiment) when it reaches the bottom end of string 32. Thereafter, the tubular string with release tool 28, drilling lock assembly 12*b* and bottom hole assembly 12*a* secured thereto may be retrieved from the casing string.

Figure 3:
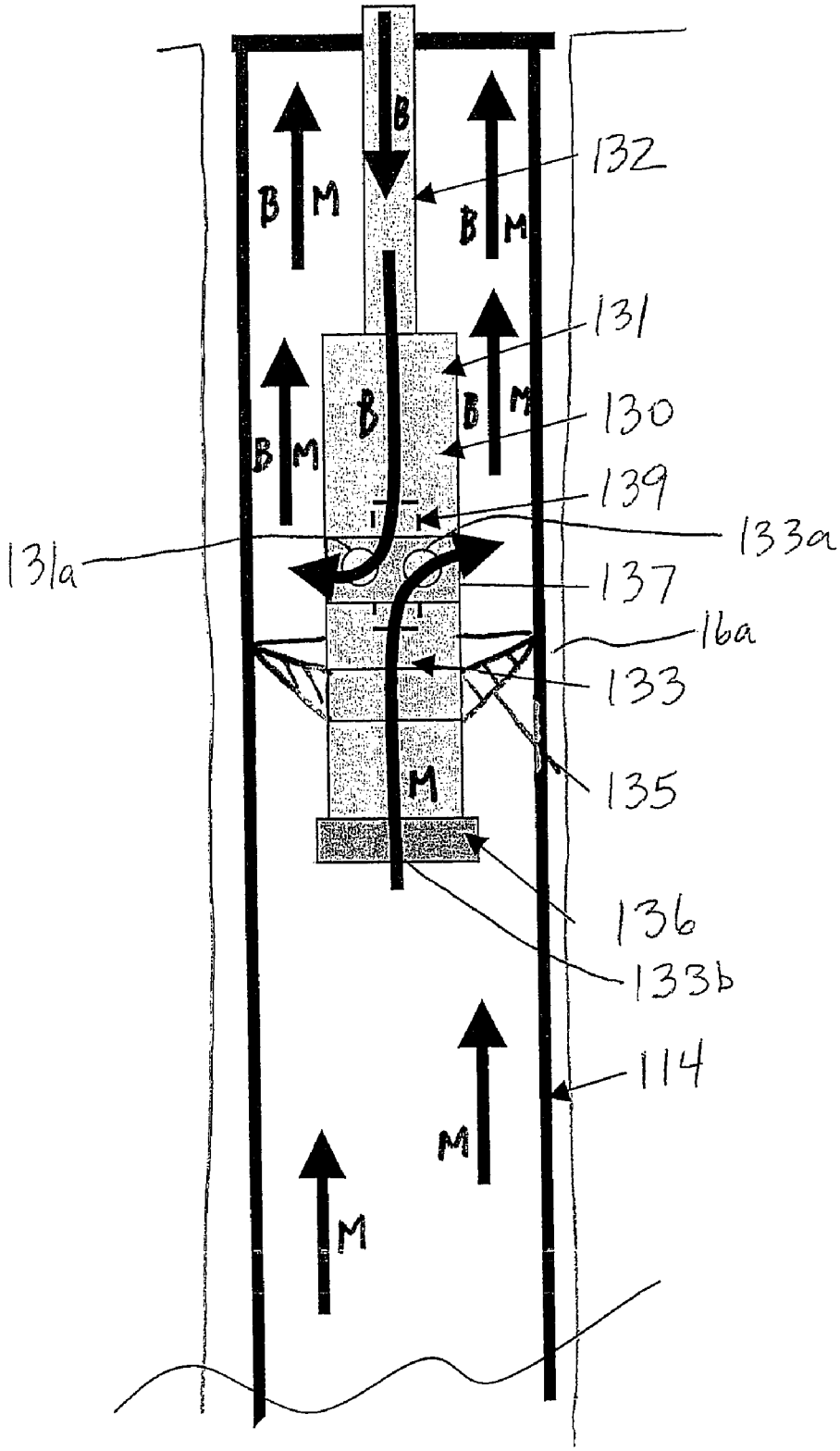
FIG. 3 is another schematic view through a well bore in which an unloading assembly is operating to reduce the hydrostatic pressure in a casing string inner diameter.

With reference to FIG. 3, a portion of another well bore is shown with a casing string unloading device 130 positioned in a string of casing 114. Device 130 includes a mud motor 131 and a positive displacement pump 133. The mud motor and positive displacement pump may be positioned one above the other or built into the same housing to react the reverse torque to tubular string 132. To create a pressure differential between the casing string inner diameter and annulus 16*a* in this illustrated embodiment, device 130 may be made up on a tubular string 132 such as drill pipe and run into the casing. By operating mud motor 131 and displacement pump 133, a pressure differential may be generated to suck any bottom hole assembly (not shown) therebelow out of the well. A packer cup 135 may be carried on device 130 in a position below a motor discharge port 131*a* and a pump discharge port 133*a* to seal the annulus between the device and casing 114 below the discharge port of the pump. In the illustrated embodiment, the pump and the motor are integrated such that their discharge ports 131*a* and 133*a* may be formed in a fluid exit section 137 of the tool and the packer may be installed between that fluid exit section and an intake port 133*b* of the pump.

In operation, fluid could be pumped (arrows B) into tubular string 132 to turn the mud motor and discharge the fluid into an annulus about tubular string 132. The mud motor so driven turns by a drive shaft 139 connection pump 133 located below it. The pump may be set up to draw fluid (arrows M) in the casing string below the pump upwardly and discharge it through port 133*a* into an annulus above packer cup 135. The fluid introduced to drive motor 131 and drawn from below the device may be prevented from passing back downhole by the seal provided by packer cup 135. As fluid is drawn from the casing ID below the device, the annulus about casing 114 may be filled to thereby lift a drilling assembly toward surface.

Device 130 may include a latch device 136 to engage the drilling assembly when it reaches the device. Thereafter, string 132, device 130 and the engaged drilling assembly may be tripped to surface.

The present process may generate significant lift. Although not meant to be limiting, but only as an example, if a tubular string of five stands of drill pipe (totaling 465' long) were run into a casing string and air was injected therethrough into the casing string inner diameter, 465' of mud would be unloaded from the casing string hydrostatic pressure. This would result in approximately 250 psi differential pressure between the casing string inner diameter and the annulus. In a well bore with 9⅝" casing size, this pressure differential may result in approximately 14,000 lbs of force.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. A process for retrieving a bottom hole assembly through a casing string, the method comprising:

installing a casing string in a borehole, the casing string including a bottom hole assembly releasably engaged thereto and moveable through an inner diameter of the casing string;

releasing the bottom hole assembly from engagement with the casing string;

reducing hydrostatic pressure in the casing string inner diameter above the bottom hole assembly so that the casing string inner diameter hydrostatic pressure immediately above the bottom hole assembly is lower than a hydrostatic pressure below the bottom hole assembly, creating a differential pressure on the bottom hole assembly by an amount sufficient to lift the bottom hole assembly;

the differential pressure permitting reverse circulation down through an annulus between the casing string and the borehole to permit the bottom hole assembly to rise up through the casing string toward the surface; and retrieving the bottom hole assembly from the casing string.

2. The process of claim 1 wherein reducing hydrostatic pressure includes replacing an existing fluid in the casing string above the bottom hole assembly with a fluid lighter than the existing fluid.

3. The process of claim 1 wherein reducing hydrostatic pressure includes creating suction in the casing string above the bottom hole assembly.

4. The process of claim 1 wherein reducing hydrostatic pressure includes injecting a fluid lighter than the existing fluid into the casing string inner diameter to lift an existing fluid from the casing string above the bottom hole assembly.

5. The process of claim 1 wherein reducing hydrostatic pressure includes pumping fluid from the casing string above the bottom hole assembly out of the casing string.

6. The process of claim 1 wherein permitting reverse circulation includes allowing fluid to flow into an upper end of the annulus.

7. The process of claim 1 wherein permitting reverse circulation includes pumping fluid into an upper end of the annulus.

8. The process of claim 1 wherein permitting reverse circulation includes increasing the fluid pressure in the annulus.

9. The process of claim 1 wherein installing the casing string includes drilling with the casing string acting as a drill string.

10. The process of claim 1 wherein installing the casing string includes running the casing string into the borehole.

11. The process of claim 1 wherein:

the method further comprises adjusting the differential pressure to control a speed at which the bottom hole assembly is retrieved.

12. A method of retrieving a bottom hole assembly secured to a string of casing positioned in a wellbore while drilling the wellbore with the string of casing, the casing being surrounded by an annulus that has an upper end at top of the wellbore, the string of casing and the annulus containing a drilling fluid, the method comprising:

(a) conveying a release tool down the string of casing into engagement with the bottom hole assembly, and with the release tool, releasing the bottom hole assembly from its engagement with the string of casing; and (b) reducing a hydrostatic pressure of the drilling fluid within the string of casing at the bottom hole assembly to a level sufficiently less than the hydrostatic pressure of the drilling fluid at a lower end of the annulus so as to induce a downward flow of the drilling fluid from the annulus to a lower end of the string of casing and up into the string of casing for lifting the bottom hole assembly.

13. The method according to claim 12, wherein step (a) comprises pumping the release tool down the string of casing.

14. The method according to claim 12, wherein step (b) comprises lowering a density of the drilling fluid within the string of casing by injecting a fluid of less density than the drilling fluid into the string of casing.

15. The method according to claim 12, wherein step (b) comprises replacing the drilling fluid in the string of casing with a fluid that has a lighter density than the drilling fluid in the annulus.

16. The method according to claim 12, wherein step (b) further comprises without increasing the hydrostatic pressure of the drilling fluid at the lower end of the annulus, flowing drilling fluid into the upper end of the annulus as the drilling fluid in the annulus flows into the string of casing.

17. A method of retrieving a bottom hole assembly, the bottom hole assembly being sealed by an annular seal to an inner wall of a string of pipe, the string of pipe being located within a wellbore, defining an annulus around the string of pipe, the annulus and the string of pipe containing a drilling fluid, the method comprising:

displacing drilling fluid within the string of pipe above the bottom hole assembly with a fluid of less density than the density of the drilling fluid in the annulus, creating an upward acting differential pressure across the seal in an amount sufficient to lift the bottom hole assembly;

moving the bottom hole assembly upward in the string of pipe in response to the differential pressure; and the less dense fluid in the pipe above the bottom hole assembly causing the drilling fluid in the annulus to flow downward to the lower end of the string of pipe and upward into the string of pipe below the seal as the bottom hole assembly moves upward in the string of pipe.

18. The method according to claim 17, further comprising:

without increasing pressure on the upper end of the annulus, flowing fluid into an upper end of the annulus as the drilling fluid in the annulus flows into the string of pipe.

19. The method according to claim 17, wherein displacing the drilling fluid within the string of pipe comprises displacing the drilling fluid within the string of pipe with water.

20. The method according to claim 17, wherein the differential pressure is selected to provide an upward force on the bottom hole assembly greater than a weight of the bottom hole assembly within the fluid.

21. The method according to claim 1, wherein reducing hydrostatic pressure in the casing string comprises lowering a density of the fluid within the string of pipe.

* * * * *